US010182634B1

(12) United States Patent
Rathery

(10) Patent No.: US 10,182,634 B1
(45) Date of Patent: Jan. 22, 2019

(54) NAIL POLISH REMOVER ASSEMBLY

(71) Applicant: Eileen Rathery, Lauderdale Lakes, FL (US)

(72) Inventor: Eileen Rathery, Lauderdale Lakes, FL (US)

( * ) Notice: Subject to any disclaimer, the term of this patent is extended or adjusted under 35 U.S.C. 154(b) by 355 days.

(21) Appl. No.: 15/072,876

(22) Filed: Mar. 17, 2016

(51) Int. Cl.
*A45D 29/00* (2006.01)

(52) U.S. Cl.
CPC ..... *A45D 29/007* (2013.01)

(58) Field of Classification Search
CPC ..... A45D 29/007; A45D 29/17
USPC ..... 132/73; 15/167.3
See application file for complete search history.

(56) References Cited

U.S. PATENT DOCUMENTS 4,180,884 A * 1/1980 Hess ..... A46B 13/04 15/21.1
4,282,891 A 8/1981 Duceppe
4,440,181 A 4/1984 Scherer
4,446,965 A * 5/1984 Montiel ..... A45D 29/007 132/73
4,466,452 A * 8/1984 Ferrari ..... A45D 29/007 132/75
4,474,195 A * 10/1984 Warner ..... A45D 29/007 132/73
4,530,726 A 7/1985 Montiel
4,800,606 A * 1/1989 Kolesky ..... A45D 29/007 132/73.6
4,800,904 A 1/1989 Kinseley et al.
4,964,372 A 10/1990 Zeenni et al.
5,048,547 A 9/1991 Walker
5,054,503 A * 10/1991 Keller ..... A45D 29/007 132/73
5,065,778 A 11/1991 Terrell
5,339,477 A * 8/1994 Warner ..... A45D 29/007 132/73.6
5,613,506 A * 3/1997 Kurokawa ..... A45D 29/007 132/285
5,642,913 A * 7/1997 Brown ..... A45D 29/007 132/73
5,806,536 A * 9/1998 Tietjen ..... A45D 31/00 132/73
5,810,021 A 9/1998 Walker
5,871,020 A * 2/1999 DeVone ..... B65D 47/42 132/317
6,053,184 A * 4/2000 DeVone ..... B65D 47/42 132/317

(Continued)

FOREIGN PATENT DOCUMENTS

EP 1369054 A1 12/2003
FR 2788417 A1 7/2000

*Primary Examiner* — Tatiana L Nobrega
(74) *Attorney, Agent, or Firm* — Albert Bordas, P.A.

(57) ABSTRACT

A nail polish remover assembly having a housing assembly with an exterior face that extends between an end and a first edge to define a cavity. Stored within the cavity is an absorbent matter. The absorbent matter has nail polish remover liquids, acetone, and/or rubbing alcohol-based liquids. A cap assembly has a sidewall that extends between a second edge and a top face. The top face has an opening. The opening has at least one slit having a distal end. The slits extend from the opening and taper from the opening to its respective distal end. The top face is made of a flexible material. The cap assembly is of a cooperative shape to removably snap onto the housing assembly.

1 Claim, 2 Drawing Sheets

(56) References Cited

U.S. PATENT DOCUMENTS

| | | | |
|---|---|---|---|
| 6,116,248 | A | 9/2000 | Walker |
| 6,314,965 | B1 | 11/2001 | Walker |
| 2006/0283470 | A1 | 12/2006 | Keogh |
| 2015/0189969 | A1 | 7/2015 | Jin |

* cited by examiner

NAIL POLISH REMOVER ASSEMBLY

BACKGROUND OF THE INVENTION

1. Field of the Invention

The present invention relates to make-up and beauty aid accessories, and more particularly, to nail polish remover assemblies.

2. Description of the Related Art

Applicant believes that one of the closest references corresponds to U.S. Patent Application Publication No. US 20150189969 A1, published on Jul. 9, 2015 to Wenri Jin for Steam Gel/Nail Polish Remover. However, it differs from the present invention because Jin teaches a steam gel polish and/or nail polish remover including a main unit and an end cover; the main unit includes a shell, a heating unit in the shell and a pot liner to contain the polish removing solution; five openings are on the surface of the end cover for five human fingers to push in; the inner surface of the end cover is covered with a silicone rubber sealing ring, containing five insertion holes to respectively coordinate with the openings; when human fingers are pushed into the slots, the fingers will be tightly pressed and fit to the five insertion holes.

Applicant believes that another reference corresponds to U.S. Patent Application Publication No. US 20060283470 A1, published on Dec. 21, 2006 to Eleanor Keogh for Nail Polish Remover, Especially For Toes. However, it differs from the present invention because Keogh teaches a nail polish removing device (1) particularly suited for removing nail polish from toenails, comprising a container (4) having a transverse opening (3) for receiving a toenail, a porous and pliable medium (2) disposed in the container (4) and adapted for scrubbing a toenail, a solution compartment located in a lower portion of the container (1), the solution compartment being capable of holding nail polish removing solution and facilitating contact of nail polish removal solution with the porous and pliable medium (2) to wet the medium (2) to facilitate nail polish removal. The (1) device may include suction cups (5) or other means for attachment to a floor or other surface.

Applicant believes that another reference corresponds to U.S. Pat. No. 6,314,965 B1 issued to Alvin M. Walker on Nov. 13, 2001 for Thumb and Fingernail Polish Remover Device. However, it differs from the present invention because Walker teaches a nail polish remover device adapted for removing fingernail polish from all the fingers and thumb on a hand comprising a cylindrical receptacle defining a chamber with a plurality of integrally formed brush members secured to the inner wall of the cylindrical receptacle and extending inward into the chamber. A cover member is secured to the cylindrical receptacle so that a neck formed on one side of the cover member forms a finger insertion aperture in connection with an axially aligned splash member formed on the other side of the cover member defining a passageway leading into the bristles of the brush members positioned in the cylindrical receptacle allowing the finger of a user to be inserted for removal of nail polish from the user's fingernails.

Applicant believes that another reference corresponds to U.S. Pat. No. 6,116,248 A issued to Alvin M. Walker on Sep. 12, 2000 for Thumb and Fingernail Polish Remover Device. However, it differs from the present invention because Walker teaches a nail polish remover device adapted for removing fingernail polish from all the fingers and thumb on a hand comprising a cylindrical receptacle defining a chamber with a brush insert assembly mounted within the chamber. The brush insert assembly defines a plurality of finger holes with adjacent semicylindrical support members to receive bristle members, which are mounted in the semicylindrical support members allowing the finger and thumb of a user to remove nail polish from the users fingernails.

Applicant believes that another reference corresponds to U.S. Pat. No. 5,810,021 A issued to Alvin M. Walker on Sep. 22, 1998 for Nail Polish Remover Device. However, it differs from the present invention because Walker teaches a nail polish remover device adapted for removing fingernail polishes that comprises a cylindrical receptacle defining a chamber, an interior annular channel on the cylinder wall and a peripheral channel on the receptacle base. The receptacle also has a central post portion and is provided with a removable, flexible liner disposed within the chamber and having bristles extending toward the central post portion and an annular rib around the exterior which mates with the interior annular channel on the cylinder wall. When the removable liner is in place in the chamber the exterior rib is positioned in the annular channel of the container and the distal end of the liner is in contact with the bottom of the peripheral channel of the container.

Applicant believes that another reference corresponds to U.S. Pat. No. 5,613,506 A issued to Sumie Kurokawa on Mar. 25, 1997 for Device for Removing Manicure. However, it differs from the present invention because Kurokawa teaches a device for removing a manicure coating from a nail at a fingertip formed of a container, a soft material impregnated with a manicure removing solution and disposed in the container, a closure removably attached to the upper portion of the container for opening and closing the container, an inner closure rotatably attached to the upper portion of the container and having an opening and a cover for closing the opening, and a sheath attached to the inner closure and extending downwardly therefrom to be situated inside the container. The sheath has a side portion, an inner space at least partly surrounded by the side portion and communicating with the opening, and an open portion formed at the side portion. When the fingertip is inserted into the sheath through the opening, the nail can be located in the open portion. In this position, when the finger is turned together with the inner closure, the manicure coating can be removed from the nail by the manicure removing solution contained in the soft material.

Applicant believes that another reference corresponds to U.S. Pat. No. 5,065,778 A issued to Joye L. Terrell on Nov. 19, 1991 for Finger Nail Polish Removing Device. However, it differs from the present invention because Terrell teaches a finger nail polish removing structure including a container for holding nail polish removing liquid with a base and a lid, and a finger nail scrubbing structure mounted within the container in spaced relation to the container base bottom wall and to the lid top wall, defining a liquid chamber in the base and an upper chamber above the finger nail scrubbing structure. The finger nail scrubbing structure is supported within the container base, and includes five finger bore openings with four bore openings, of substantially equal diameter on a circle within the planar extent of the finger nail scrubbing structure and with the fifth bore opening a thumb tip receiving opening of greater diameter than the other four finger openings and displaced closer to the center of the finger nail scrubbing structure to receive simultaneously the finger nails and nail finger tips to the nail end joints of all five fingers of one hand. The finger bore openings present sponge-like scrubbing material inner walls to remove nail polish from the nails, and the nail polish removing liquid is sloshed between the bottom and the upper chambers to saturate the finger bore opening wall surfaces with cleaning liquid and after use to clean the walls.

Applicant believes that another reference corresponds to U.S. Pat. No. 5,054,503 A issued to Walter Keller on Oct. 8, 1991 for Closable Container Having Abrasive Body In Finger Treating Solution. However, it differs from the present invention because Keller teaches a container for treating fingers or finger nails that includes a cup with a sponge therein immersed in a treatment solution. The container is provided with a double walled seal, which is connected positively and/or non-positively to the inner wall of the cup of the container. At the top, the inner seal engages against a shoulder of the cup and secures the underlying sponge. The sponge has a vertically extending hole for receiving a finger to be treated. The sponge absorbs the liquid or solution contained in the cup for treating finger. The hole can be provided with a replaceable lining. Closable slits are provided in the seal for the insertion of the finger, so that no liquid flows out or evaporates. The seal can be held on its circumference by a spring ring, which engages against a cam or is located in a groove in the inner wall of the cup and is consequently positively held.

Applicant believes that another reference corresponds to U.S. Pat. No. 5,048,547 A issued to Alvin M. Walker on Sep. 17, 1991 for Nail Polish Remover Container. However, it differs from the present invention because Walker teaches a manicuring device adapted for removing fingernail polish comprising a cylindrical receptacle defining an interior chamber with a plurality of integral bristle members spaced in rows and projecting inward to define a finger insertion area.

Applicant believes that another reference corresponds to U.S. Pat. No. 4,964,372 A issued to Joseph Zeenni, et al. on Oct. 23, 1990 for Fingernail Treating Device. However, it differs from the present invention because Zeenni teaches a fingernail device comprising a container having first and second compartments. A liquid metering valve divides the two compartments. A liquid absorbing sponge having a finger receiving hole is disposed in the first, upper compartment. Nail polish remover is disposed in the second, lower compartment. The second compartment has squeezable sidewalls whereby, upon squeezing, an amount of liquid is supplied to the first compartment to fill the liquid absorbing sponge with nail polish remover.

Applicant believes that another reference corresponds to U.S. Pat. No. 4,800,904 A issued to Peter B. Kinseley, et al. on Jan. 31, 1989 for Article for Removing Nail Polish from a Nail. However, it differs from the present invention because Kinseley teaches an article for removing nail polish from a nail, which comprises a sealed envelope having rupturable means along and adjacent to at least one edge thereof to allow for entry of a nail containing nail polish into the interior of the envelope, and an absorbent material, bonded to the inner surfaces of the envelope, which is impregnated with a nail polish remover.

Applicant believes that another reference corresponds to U.S. Pat. No. 4,530,726 A issued to Alexandra Montiel on Jul. 23, 1985 for Fingernail Refinishing Product and Method. However, it differs from the present invention because Montiel teaches a fingernail refinishing product and method for dissolving and removing old lacquer nail polish, for softening and conditioning fingernails, cuticles and surrounding skin, and for depositing a clear nail-strengthening priming coat, all simultaneously, in preparation for the application of fresh nail polish. The product comprises a spill-proof applicator in the form of a reclosable container filled with a slitted sponge saturated with a water-miscible liquid composition which contains solvents, film-forming and nail-strengthening ingredients, and substantial amounts (up to 25% by weight) of an emollient-emulsifier-cleaner formed by the sulfonation reaction of the ricinoleic acid in castor oil. The three-function fingertip treatment—polish removal, conditioning, and nail prime-coating—takes place inside the applicator and is accomplished by the insertion of each fingertip, at least one at a time, into contact with the liquid saturated sponge.

Applicant believes that another reference corresponds to U.S. Pat. No. 4,474,195 A issued to Ronald C. Warner on Oct. 2, 1984 for Nail Polish Removal Devices Having Supply Containers. However, it differs from the present invention because Warner teaches a device for treating the fingernails and particularly for removal of nail polish from the nails. It provides a treatment container having an absorbent member disposed therein, which is soaked with a liquid nail polish removal solvent, at least one finger being received within an aperture formed in the absorbent member to contact the nail with the solvent and with surfaces of the aperture to remove a polish coating from the nail. It particularly provides a supply container on which the treatment container can be carried, the interior of the supply container connecting with the interior of the treatment container through a valve in a cap element closing the supply container, thereby to allow liquid nail polish removal solvent stored within the supply container to be dispensed as desired into the treatment container. A user can thus replenish the supply of liquid nail polish removal solvent within the treatment container when usage of the treatment container renders a previous charge of the liquid solvent unfit for use.

Applicant believes that another reference corresponds to U.S. Pat. No. 4,466,452 A issued to Luigi M. Ferrari on Aug. 21, 1984 for Fingernail Treatment Arrangement. However, it differs from the present invention because Ferrari teaches a fingernail treatment arrangement, especially a nail polish removal arrangement that includes a vessel which is closable by a lid and which includes a circumferential wall and a bottom wall, which together bound an internal chamber. A porous body is so held in the internal chamber as to be inwardly spaced from the circumferential wall and to form a gap therewith. The porous body has a central through bore, which extends through the porous body all the way to the bottom wall. The bottom wall has a downward slope in the radially outward direction to form a moat into which the porous body dips. The porous body is held in the aforementioned position either by a resilient spring clip which engages the same and braces itself against a neck portion of the vessel, or by ultrasonically or thermally welded formations connecting the porous body to the bottom wall, or in both ways. A treating liquid, especially a nail polish removing liquid, is poured into the internal chamber to flow into the gap and/or into the fingerhole and to permeate the porous body through the top and through the outer and/or inner circumferential surfaces thereof from the gap and/or from the finger hole. Rubbing a fingernail in the finger hole against the liquid-soaked porous body will dissolve and rub off the nail polish from the fingernail.

Applicant believes that another reference corresponds to U.S. Pat. No. 4,440,181 A issued to John S. Scherer on Apr. 3, 1984 for Nail Polish Remover Kit. However, it differs from the present invention because Scherer teaches a nail polish remover kit for removing nail polish from fingers and toenails. The kit has a pear-shaped jar containing a nail polish remover saturated filler. The filler is constricted at the top by the constricted upper portion of the jar to prevent both rotation of the filler and visual sighting of the sludge at the bottom of the jar, produced by nail polish removal process. The filler possesses an opening for inserting a finger having a nail from which polish is to be removed. The opening may be formed from filler surfaces which are smooth or uneven, and, if uneven, preferably corrugated. The opening is dimensioned so that excess nail polish remover is wiped from the finger as it is removed from the filler. The kit also contains a dauber with an absorbent end that the filler opening is designed to receive. This dauber may be removed from the filler to remove polish from toenails, fingernails, and the like.

Applicant believes that another reference corresponds to U.S. Pat. No. 4,282,891 A issued to Antoine Duceppe on Aug. 11, 1981 for Fingernail Treating Device. However, it differs from the present invention because Duceppe teaches a device for use in treating fingernails with a liquid, such as a nail polish remover. The device comprises a flat-bottomed, cylindrical container having an open top normally closed by a cover. A cylindrical sponge is press-fitted into the container to be frictionally held in place. A finger hole is provided in the sponge. Treatment liquid is poured into the container to be absorbed by the sponge to a level where it can act on the end of a finger inserted into the hole. The finger fits snugly in the hole and is rotated or oscillated therein to assist the treatment.

Applicant believes that another reference corresponds to Patent No. EP 1369054 A1 issued to Kurokawa Sumie on Dec. 10, 2003 for Device for Removing Nail Varnish. However, it differs from the present invention because Sumie teaches a device for removing enamel from the nails comprising: a preferably cylindrical container having bottom for accommodating, along the inner wall surface thereof, a spongy member impregnated with a removing solution; one or more finger/toe protection sheaths of the shape of a cylinder having bottom and having a nail exposure window opening upward from near the lower ends thereof or of the shape of a nearly hollow cone shrinking toward the bottom, said finger/toe protection sheaths being suspended at their flange portions from the upper opening ends so as to rotate and being pivoted on the bottom of the cylindrical container having bottom; and a container closure having an inverse U-shape in cross section and screwed onto a threaded portion near the upper opening end; wherein the axis of the lower ends of the finger/toe protection sheaths is deflected from the finger/toe axis in direction opposite to the nail exposure window by an angle $\upsilon$ of intersection of $1° \leq \upsilon \leq 30°$.

Applicant believes that another reference corresponds to Patent No. FR 2788417 A1 issued to Joulia Gerard on Jul. 21, 2000 for Fingernail Treatment Product. However, it differs from the present invention because Gerard teaches a pot containing a block of foam material impregnated with a treatment substance such as nail varnish remover, and a scraper in the form of an elastomer, fabric or thermoplastic plate, which goes over the foam block and has one or more slits forming at least one lip for removing the varnish from the finger nail as the finger tip is withdrawn.

Other patents describing the closest subject matter provide for a number of more or less complicated features that fail to solve the problem in an efficient and economical way. None of these patents suggest the novel features of the present invention.

SUMMARY OF THE INVENTION

The present invention is a nail polish remover assembly, comprising a housing assembly having an exterior face that extends between an end and a first edge to define a cavity. In a preferred embodiment, the housing assembly is symmetrical, and comprises a valley and a ridge.

Stored within the cavity is an absorbent matter. The absorbent matter is a natural sponge or a synthetic sponge. The absorbent matter is removable from the housing assembly and is shaped to fit within the cavity. Within the cavity, the absorbent matter is biased against the end and extends a predetermined distance towards the first edge without reaching the first edge. The absorbent matter comprises nail polish remover liquids, acetone, and/or rubbing alcohol-based liquids.

A cap assembly comprises a sidewall that extends between a second edge and a top face. The top face comprises an opening. In a preferred embodiment, the cap assembly is symmetrical, and comprises a valley and a ridge. The opening comprises at least one slit having a distal end. The slits extend from the opening and taper from the opening to its respective distal end. The top face is made of a flexible material. The cap assembly is of a cooperative shape to removably snap onto the housing assembly.

It is therefore one of the main objects of the present invention to provide a nail polish remover assembly that is volumetrically efficient for carrying, transporting, and storage.

It is another object of this invention to provide a nail polish remover assembly that can be readily assembled and disassembled without the need of any special tools.

It is another object of this invention to provide a nail polish remover assembly, which is of a durable and reliable construction.

It is yet another object of this invention to provide such an assembly that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
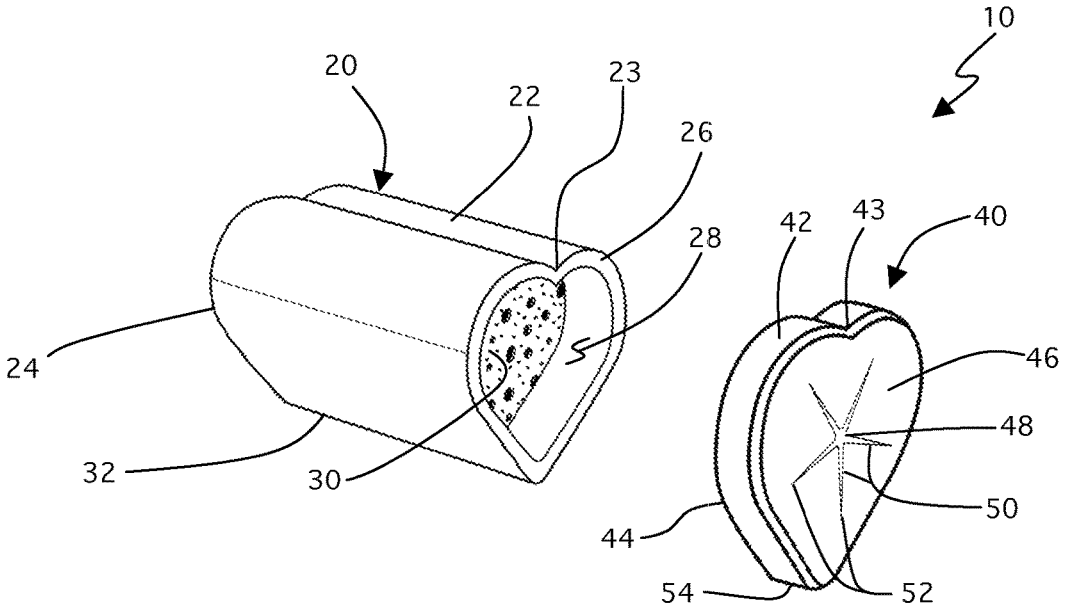
FIG. 1 is a first isometric view of a nail polish remover assembly with its cap assembly removed from a housing assembly.

Referring now to the drawings, the present invention is a nail polish remover assembly, and is generally referred to with numeral 10. It can be observed that it basically includes housing assembly 20 and cap assembly 40.

Figure 2:
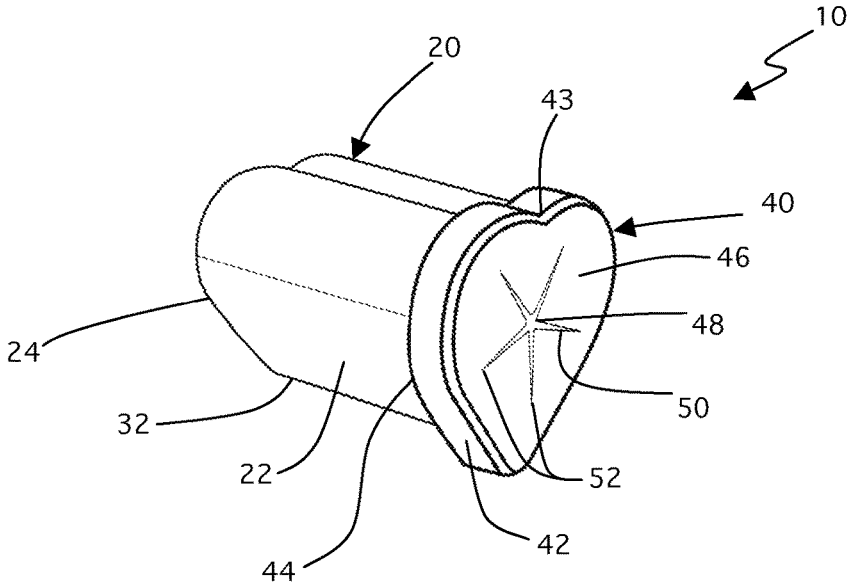
FIG. 2 is a second isometric view of the nail polish remover assembly with its cap assembly secured onto the housing assembly.

As seen in FIGS. 1 and 2, housing assembly 20 comprises exterior face 22 that extends between end 24 and edge 26 to define cavity 28. In a preferred embodiment, housing assembly 20 is symmetrical and further comprises valley 23 and ridge 32. Stored within cavity 28 is absorbent matter 30.

In a preferred embodiment, absorbent matter 30 is a natural or synthetic sponge, or another material having similar absorbent characteristics. Absorbent matter 30 is removable from housing assembly 20 and is shaped to snugly fit within cavity 28. In a preferred embodiment, absorbent matter 30 within cavity 28 is biased against end 24 and extends a predetermined distance towards edge 26 without reaching edge 26. Absorbent matter 30 comprises nail polish remover liquids, acetone, and/or rubbing alcohol-based liquids.

Cap assembly 40 comprises sidewall 42 that extends between edge 44 and top face 46. In a preferred embodiment, cap assembly 40 is symmetrical and further comprises valley 43 and ridge 54.

Figure 3:
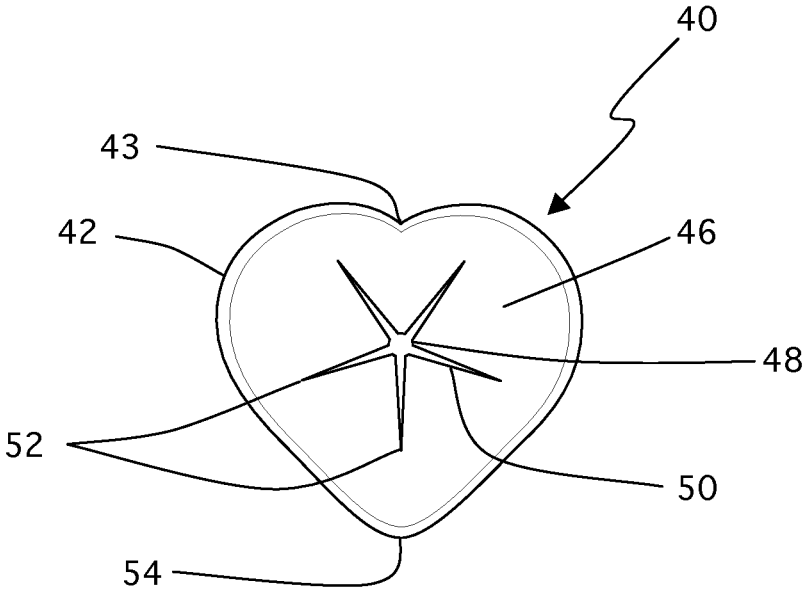
FIG. 3 is a front elevational view of the cap assembly.

As seen in FIG. 3, top face 46 comprises opening 48. Opening 48 comprises at least one slit 50 having distal end 52. In a preferred embodiment, each slit 50 extends from opening 48 and respectively tapers therefrom to its respective distal end 52. Top face 46 is made of a flexible material that is sufficiently flexible for a person to insert each finger or toe therethrough, and extend within cavity 28 to reach absorbent matter 30.

Figure 4:
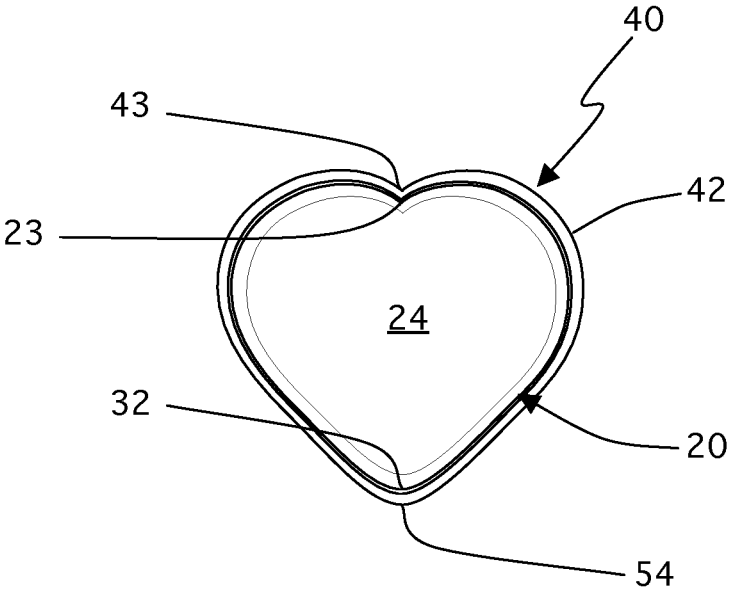
FIG. 4 is a rear elevational view of the nail polish remover assembly.

As seen in FIG. 4, cap assembly 40 is of a cooperative shape to removably snap onto housing assembly 20.

In use, the person inserts each finger or toe through opening 48, one at a time in a preferred embodiment, and biases it against absorbent matter 30. The person may also rub their fingernail or toenail against absorbent matter 30 to remove nail polish therefrom with the nail polish remover liquids, acetone, and/or rubbing alcohol-based liquids. Absorbent matter 30 may be flipped within cavity 28, replaced all together, and/or additional nail polish remover liquids, acetone, and/or rubbing alcohol-based liquids may be poured into cavity 28 when desired.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A nail polish remover assembly, consisting of:

A) a housing having an elongated wall that extends between a closed proximal end and an opposing open distal end defining a first edge, said housing being hollow to define a cavity therein, said housing and said cavity thereof are heart shaped in a cross-section transverse to a longitudinal axis extending between said closed and open ends, and said heart shape has two equal curves meeting at a point at a bottom thereof and a cusp at a top thereof, where said cusp provides a first valley and said point defines a first ridge, stored within said cavity is an absorbent matter, said absorbent matter is a natural or synthetic sponge, is removable from said housing, and has a corresponding heart shape to fit within said cavity and in abutting contact therewith, said absorbent matter within said cavity is biased against said closed proximal end and extends a predetermined distance towards said first edge without reaching said first edge such that a gap exists between a distal-most surface of said absorbent matter and said first edge, said absorbent matter has acetone or rubbing alcohol-based liquids capable of removing nail polish absorbed therein; and B) a cap assembly removably mounted to said open distal end of said housing, said cap having a sidewall that extends between a second edge and a top wall, said cap assembly being heart shaded in a cross-section transverse to a axis extending between said second edge and said too wall, the heart shape having two equal curves meeting at a point at a bottom thereof and a cusp at a too thereof, where said cusp provides a second valley and said point defines a second ridge, said top wall has a circular through hole in a central portion thereof and five equally spaced apart elongated slits extending radially outwardly from said hole, said slits extending completely through a thickness of said too wall and having a triangular shape, where said triangular shape of said slits provide a base abutting against said circular hole and an opposing apex defining an outer-most radial end of each of said slits, and one of said slits is aligned with said second ridge and said second valley where said apex thereof points toward and is positioned proximate said second ridge, said top wall is made of a flexible material, and said cap assembly is of a cooperative shape to removably snap onto said housing such that when coupled, said second edge and said sidewall of said cap extend over a distal-most portion of said elongated wall of said housing assembly and said too face of said cap extends over said first edge and said open distal end of said housing assembly;

wherein during use, a user inserts a finger or toe through said hole in said top wall, causing portions of said too wall between said slits to deflect downwardly toward said second edge in order to allow the finger or toe to be inserted through said cavity and a nail thereof to be rubbed against said absorbent matter to remove nail polish from the nail.

* * * * *